US005601201A

United States Patent [19]

Looker

[11] Patent Number: 5,601,201

[45] Date of Patent: Feb. 11, 1997

[54] AIR CARGO CONTAINER

[75] Inventor: Robert Looker, Carpinteria, Calif.

[73] Assignee: Satco Inc., El Segundo, Calif.

[21] Appl. No.: 466,827

[22] Filed: Jun. 6, 1995

Related U.S. Application Data

[63] Continuation-in-part of Ser. No. 235,681, Apr. 29, 1994, abandoned.

[51] Int. Cl.[6] ..... B65D 90/00

[52] U.S. Cl. ..... 220/1.5; 160/273.1

[58] Field of Search ..... 220/1.5; 160/271, 160/273.1

[56] References Cited

U.S. PATENT DOCUMENTS

| | | | |
|---|---|---|---|
| 2,501,454 | 3/1950 | Schueren | 160/273.1 |
| 2,871,933 | 2/1959 | Kroger | 160/271 X |
| 3,504,728 | 4/1970 | Wardlaw | 160/273.1 X |
| 3,618,803 | 11/1971 | Dobberkau et al. | 220/1.5 |
| 3,645,596 | 2/1972 | Russell-French | 220/1.5 |
| 3,972,437 | 8/1976 | Lovich et al. | 220/1.5 |
| 4,574,968 | 3/1986 | Mittelmann | 220/1.5 |
| 4,646,928 | 3/1987 | Ono et al. | 220/1.5 X |
| 4,936,477 | 6/1990 | King et al. | 220/1.5 |
| 5,044,689 | 9/1991 | Evers | 220/1.5 X |
| 5,123,474 | 6/1992 | Smith | 160/273.1 |
| 5,242,070 | 9/1993 | Bretschneider et al. | 220/1.5 |
| 5,445,209 | 8/1995 | Lichy | 160/273.1 |

FOREIGN PATENT DOCUMENTS

| | | |
|---|---|---|
| 0553626 | 3/1993 | European Pat. Off. . |
| 0541832 | 5/1993 | European Pat. Off. . |

*Primary Examiner*—Steven M. Pollard
*Attorney, Agent, or Firm*—Lyon & Lyon

[57] ABSTRACT

A cargo container for air or surface freight has roll-up doors to allow access, through the interior of the cargo container, to cargo contained in adjacent cargo containers. The roll-up doors include a curtain and a doorbar. Ramps and plates guide the roll-up doors into a pre-locked position. An internal latching mechanism closes and re-opens the roll-up door from within the cargo container interior. The curtain has sewn in springs at its edges, which are slidably contained within recesses in the door posts, so that the curtain is supported on all sides.

7 Claims, 13 Drawing Sheets

AIR CARGO CONTAINER

This application is a continuation-in-part of U.S. patent application Ser. No. 08/235,681, filed Apr. 29, 1994, and now abandoned.

BACKGROUND OF THE INVENTION

The field of the invention is cargo containers. From the beginning of manned flight, cargo of one type or another has been transported in planes. Since that time, the air freight industry has engaged in a constant effort to increase the efficiency of transporting cargo by air. For instance, it is customary to load commercial cargo into cargo containers on the ground, and then load the containers themselves onto the aircraft. FIG. 1 shows a conventional cargo container used for this purpose. This process saves time and is also more secure in-flight. Cargo is shipped in containers by air, after which, the containers are then unloaded directly onto trucks for shipping to final destinations. FIG. 2A shows a typical configuration for loading containers onto trucks.

However, disadvantages arise with this operation, when the trucks reach their destinations. The presence of Container A inhibits access to cargo in Container B and relatively few truck stations possess the capability to move cargo containers (which are typically more than 6 feet long on each edge and weigh about 500 lbs., or more, empty), such as Container A, off of the truck to allow direct access to Container B.

In the past, swinging doors for Containers A and B have been used. As shown in FIGS. 2A and 2B, door 2 of Container A swings inwardly while door 1 of Container B swings outwardly, thereby providing an accessway from the back of the truck through Container A to cargo in Container B. However, these types of swinging doors are expensive, heavy and are prone to fail after a relatively short period of service. Moreover, a significant amount of space must be cleared within Container A to allow the doors to swing inwardly into Container B.

To overcome these disadvantages, the present invention uses containers having roll-up doors. However, in use, cargo can shift or fall against a roll-up door. Thus, the roll-up door must be able to hold back or contain substantial loads. In addition, the container should advantageously be able to protect against rain entry, and be durable yet lightweight. The roll-up door should also be easily rolled up and down, and latched and locked into position. While roll-up door cargo containers have been known in the past, various disadvantages remain.

Thus, there is a need for an improved cargo container.

SUMMARY OF THE INVENTION

To these ends, an improved cargo container has roll-up doors with cables, resilient rods or springs at their sides slidably contained within a recess in a door post. This design maintains the closure integrity of the door under stress conditions. Preferably, at least two of the roll-up doors are positioned so that when cargo containers are placed adjacent to each other, a passageway between cargo containers is created by opening one door from each cargo container. Thus, access is provided, through the interior of one cargo container, to cargo held in adjacent containers.

Accordingly it is an object of the invention to provide an improved air cargo container. Other and further objects and advantages will appear hereinafter.

BRIEF DESCRIPTION OF THE DRAWINGS

In the drawings, wherein similar reference characters denote similar elements throughout the several views.

DETAILED DESCRIPTION OF THE PREFERRED EMBODIMENT

Figure 1:
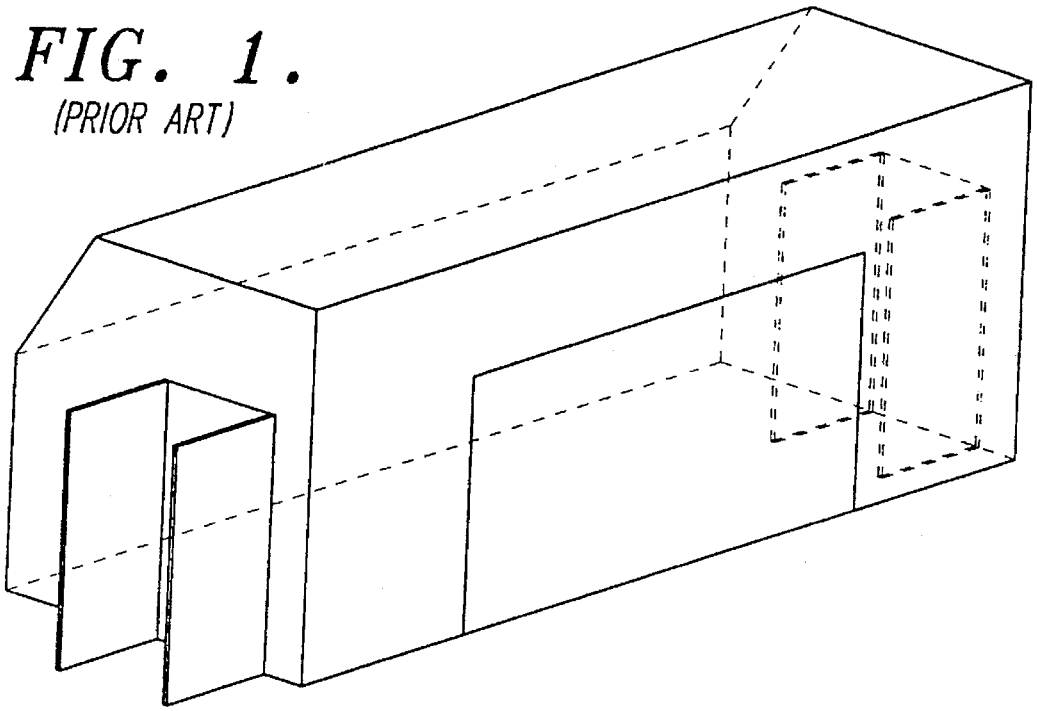
FIG. 1. (PRIOR ART)
FIG. 1 is a perspective view of a conventional cargo container.

Turning now in detail to the drawings, FIG. 1 represents a typical conventional cargo container. These cargo containers generally have seven panels: front, rear, top, bottom, a large lateral panel, a small lateral side panel, and a slanted panel connecting the small lateral panel to the top. This shape allows the container to fit within an aircraft fuselage with a minimum of wasted space.

Figure 2A:
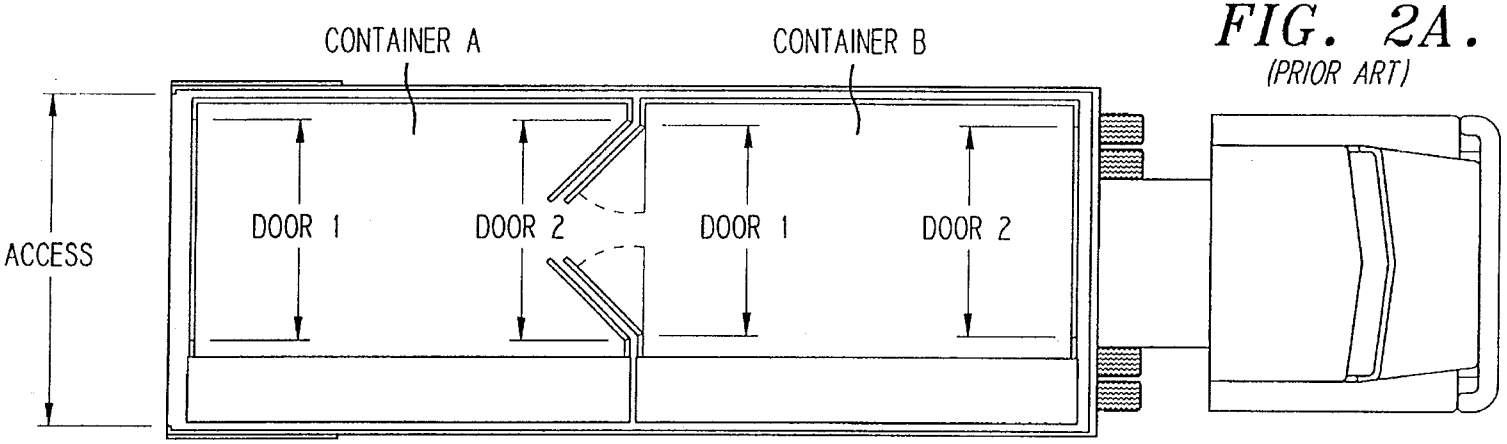
FIG. 2A. (PRIOR ART)
FIG. 2A is a plan view of a conventional configuration of cargo containers loaded onto a truck.
Figure 2B:
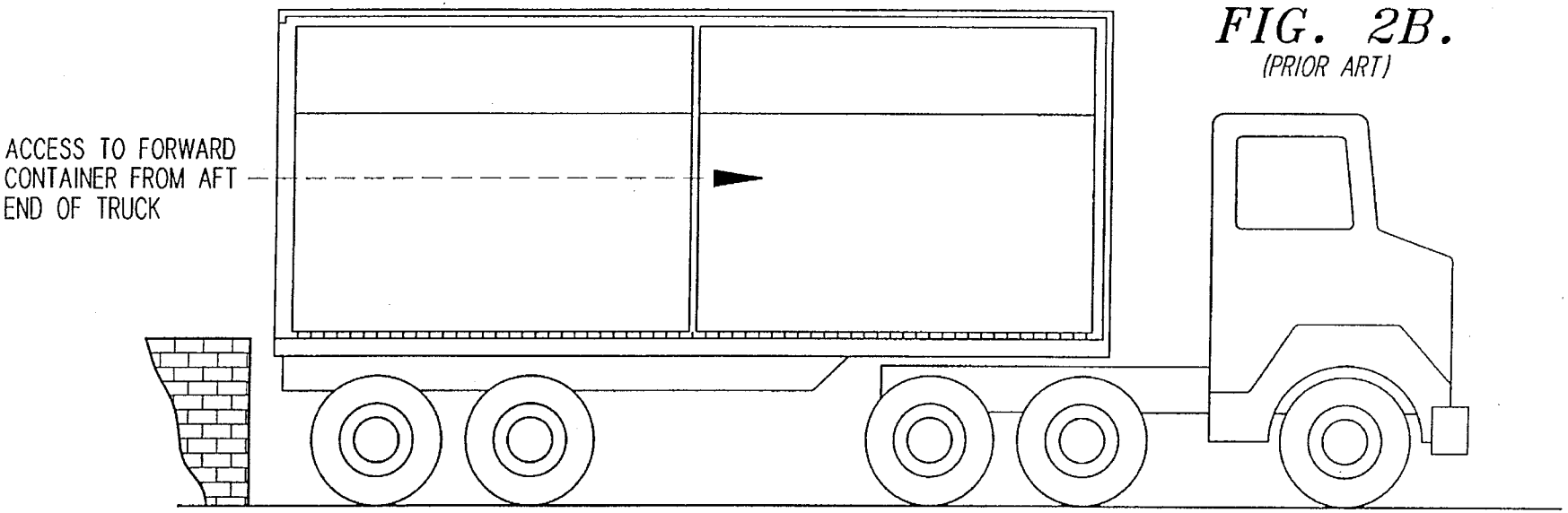
FIG. 2B. (PRIOR ART)
FIG. 2B is a side elevation view thereof.

FIGS. 2A and 2B illustrate how these cargo containers are generally loaded onto a truck for transportation.

Figure 3:
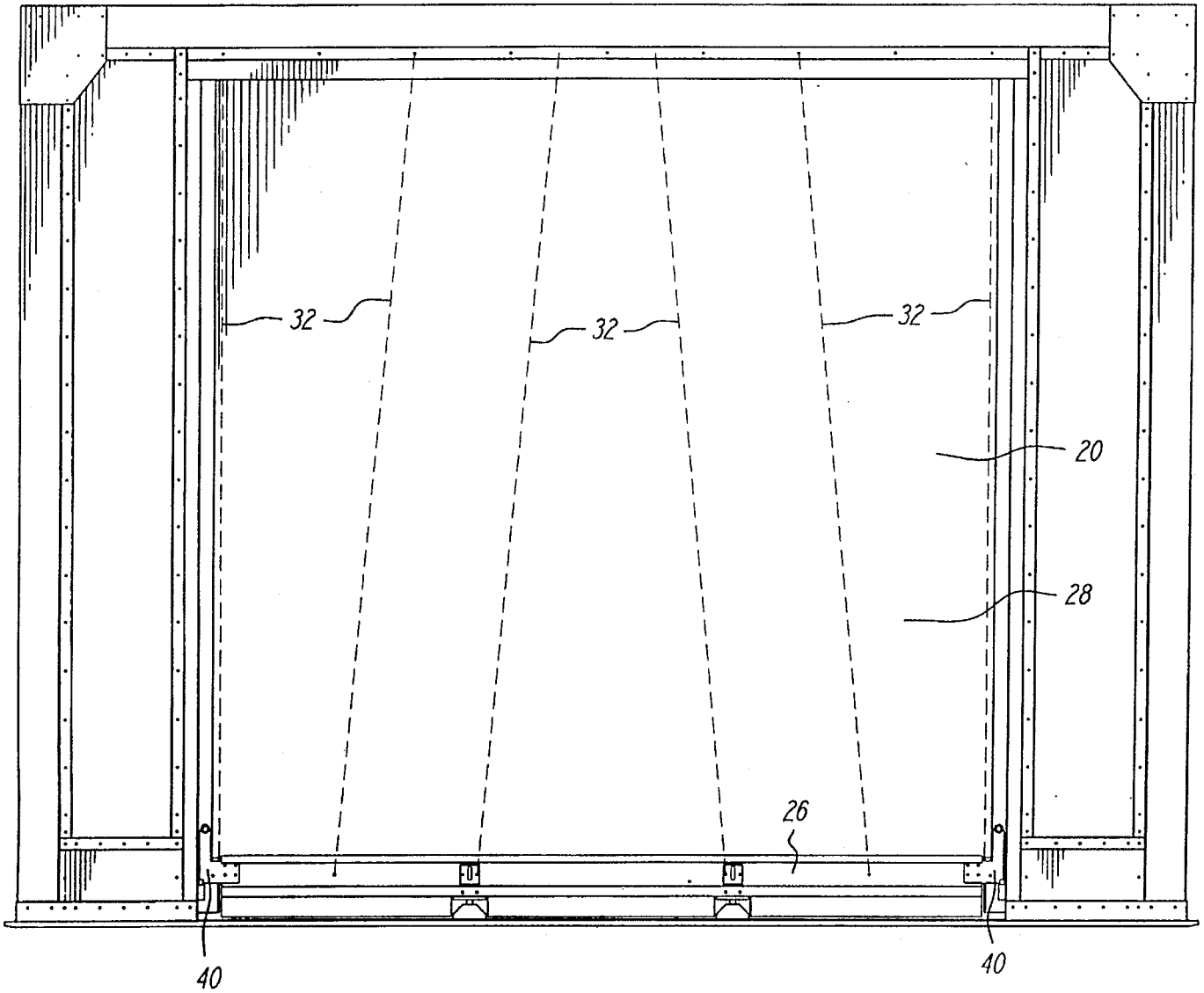
FIG. 3 is a side elevation view of the cargo container of the present invention.
Figure 4:
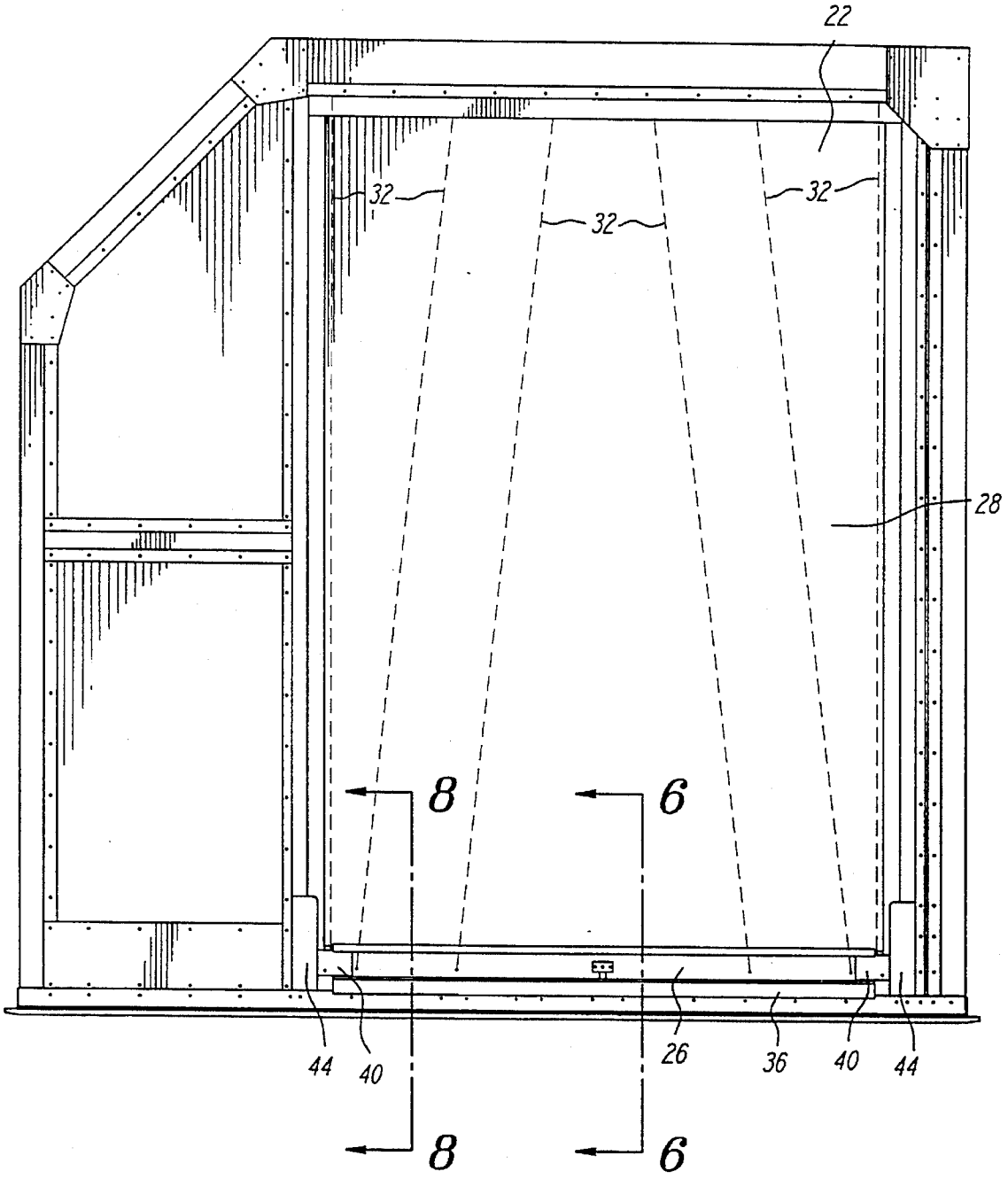
FIG. 4 is a front elevation view thereof.
Figure 5:
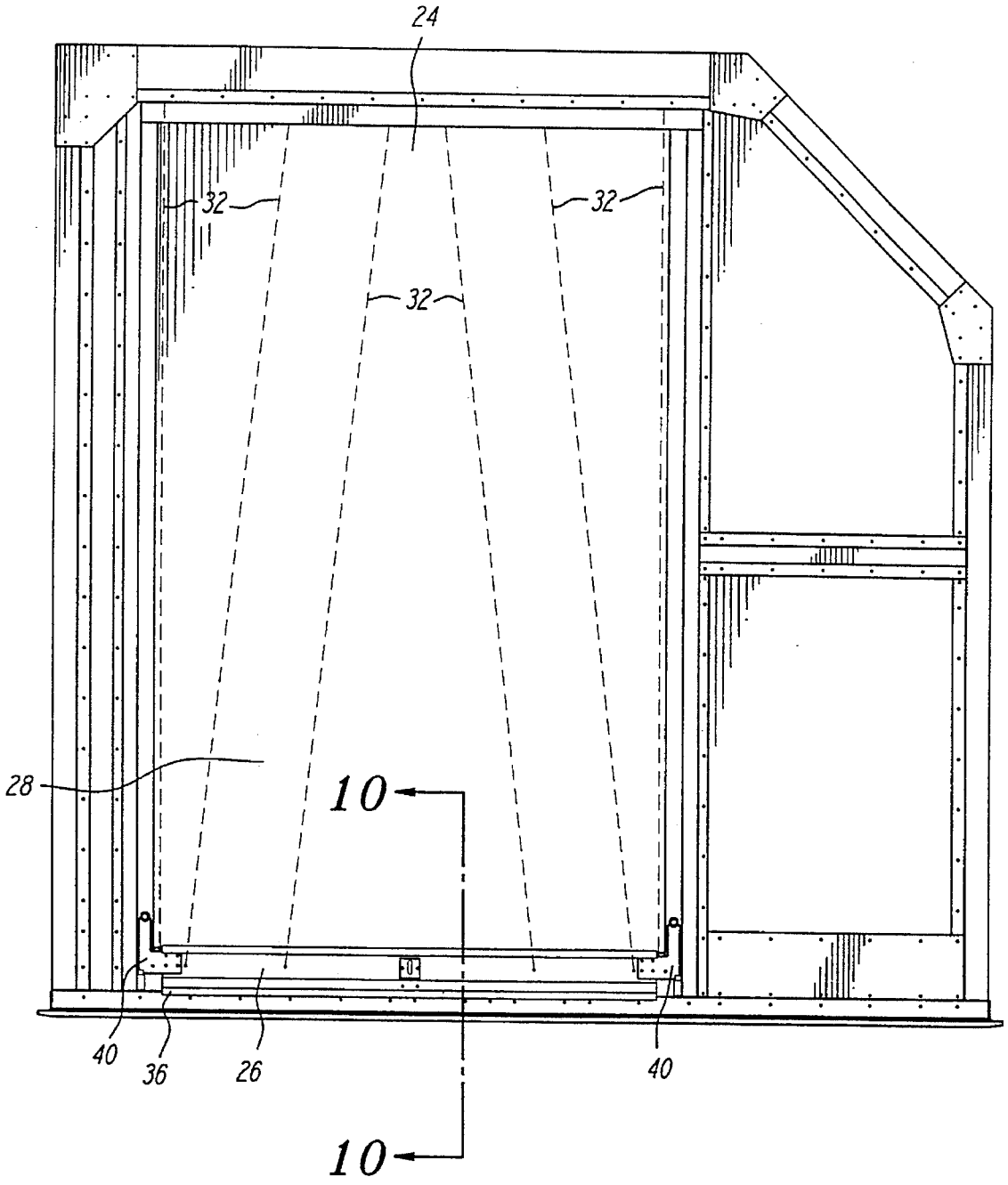
FIG. 5 is a rear elevation view thereof.

FIG. 3 shows a lateral roll-up door 20 located within the large lateral side panel. The lateral roll-up door 20 includes a doorbar 26, curtain 28, tensioning cables 32, and endplates 40. The lower ends of the tensioning cables 32 are attached to the doorbar 26 and the cables roll up with the curtain. The endplates 40 are attached to the doorbar 26. FIG. 4 shows a front roll-up door 22 located within the front panel. The front roll-up door 22 includes a doorbar 26 attached to a curtain 28, tensioning cables 32, rainguard 36, and endplates 40. Guideplates 44 are attached to the cargo container itself. As shown in FIG. 5, a rear roll-up door 24 is located within the rear panel and includes a doorbar 26 attached to a curtain 28, tensioning cables 32, rainguard 36 and endplates 40.

Figure 6:
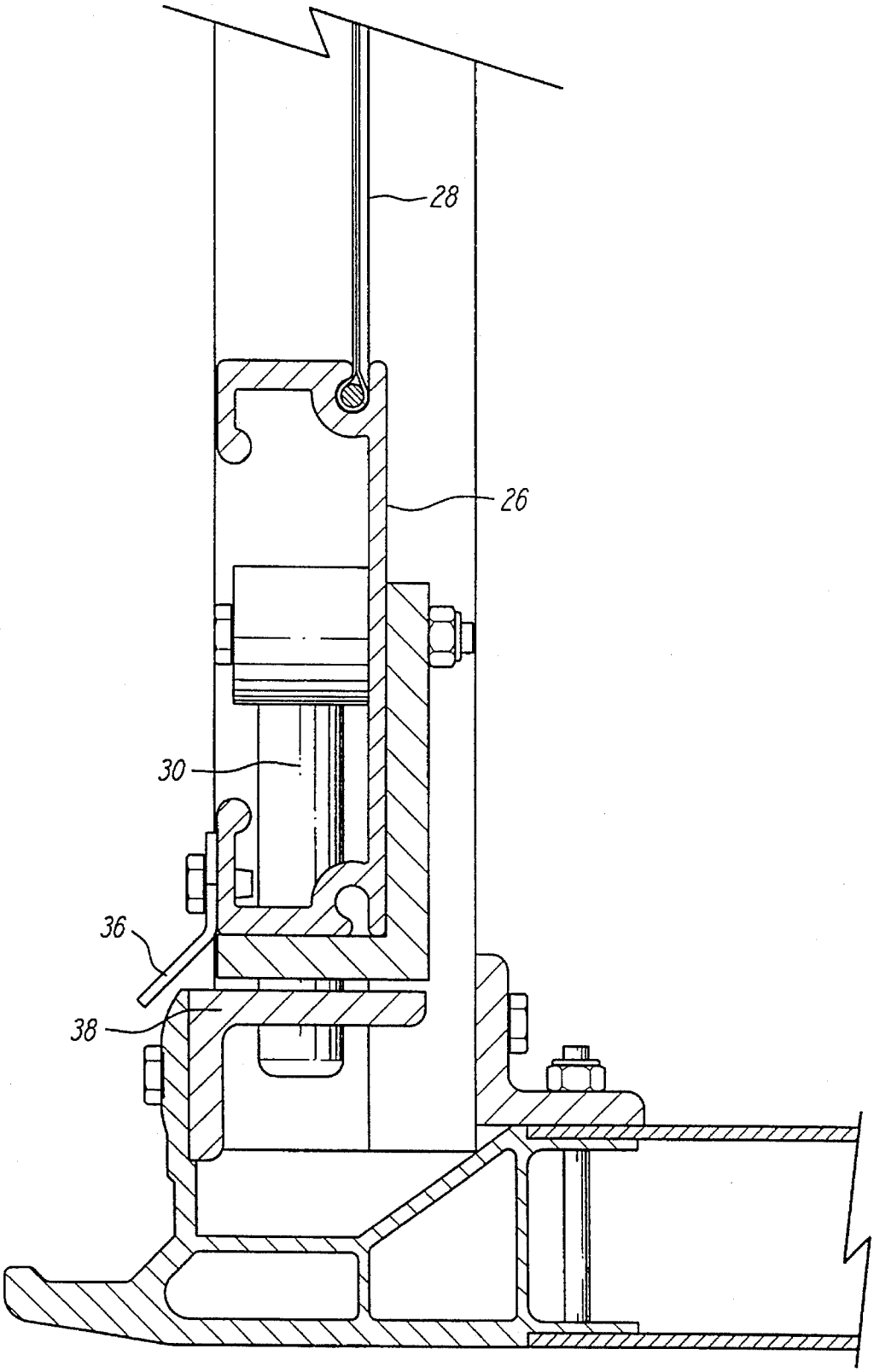
FIG. 6 is a section view of the front door taken along line 6—6 of FIG. 4.

Referring to FIG. 6, in the front roll-up door 22, the curtain 28 and rainguard 36 are attached to a doorbar 26. A fixed pin 30 is attached to the center of the doorbar 26 and a threshold angle 38 is attached to the frame of the cargo container.

Figure 7:
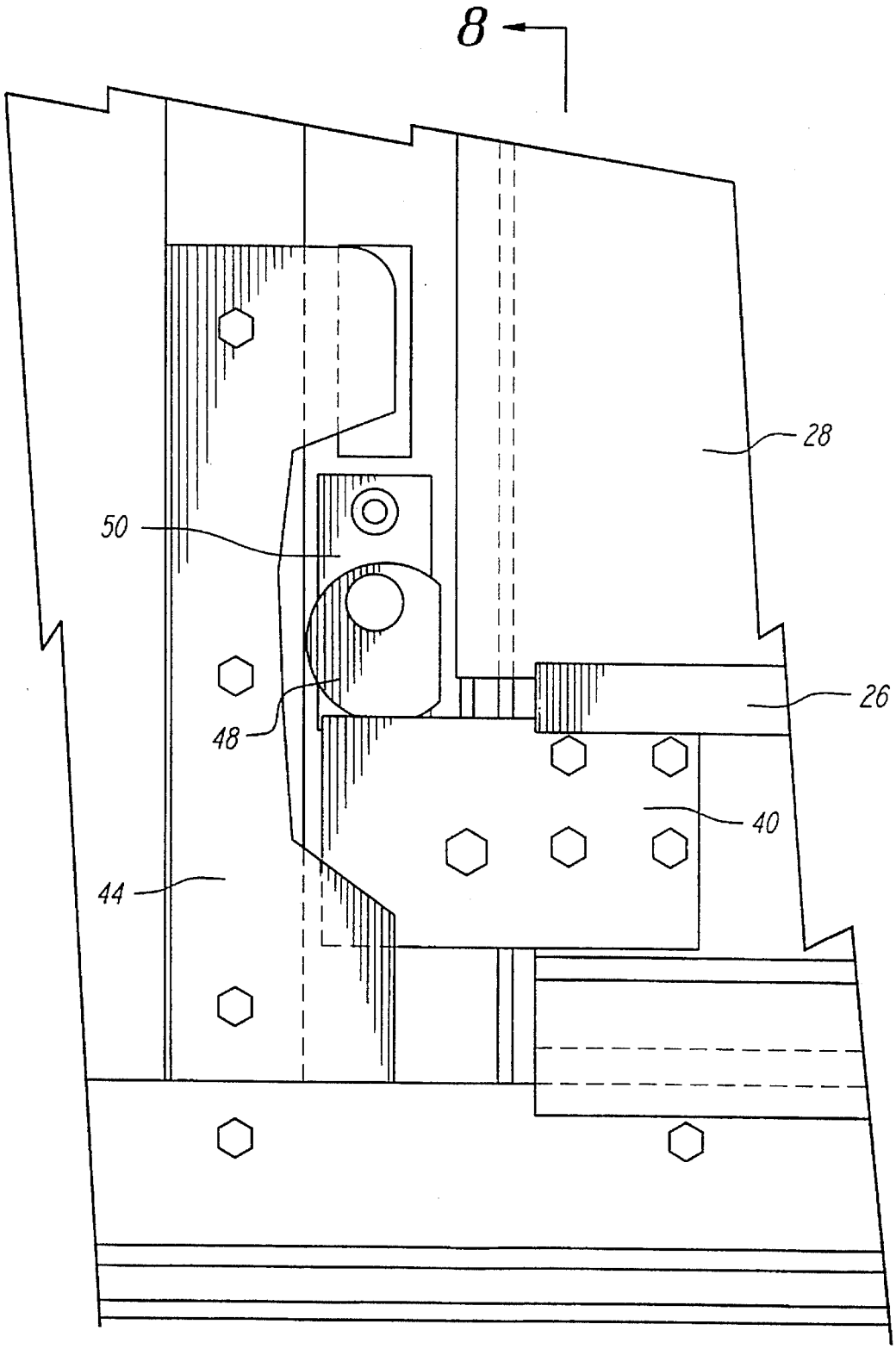
FIG. 7 is an enlarged front elevation view of the latching mechanism for the front door with the guideplate partially cut away.
Figure 8:
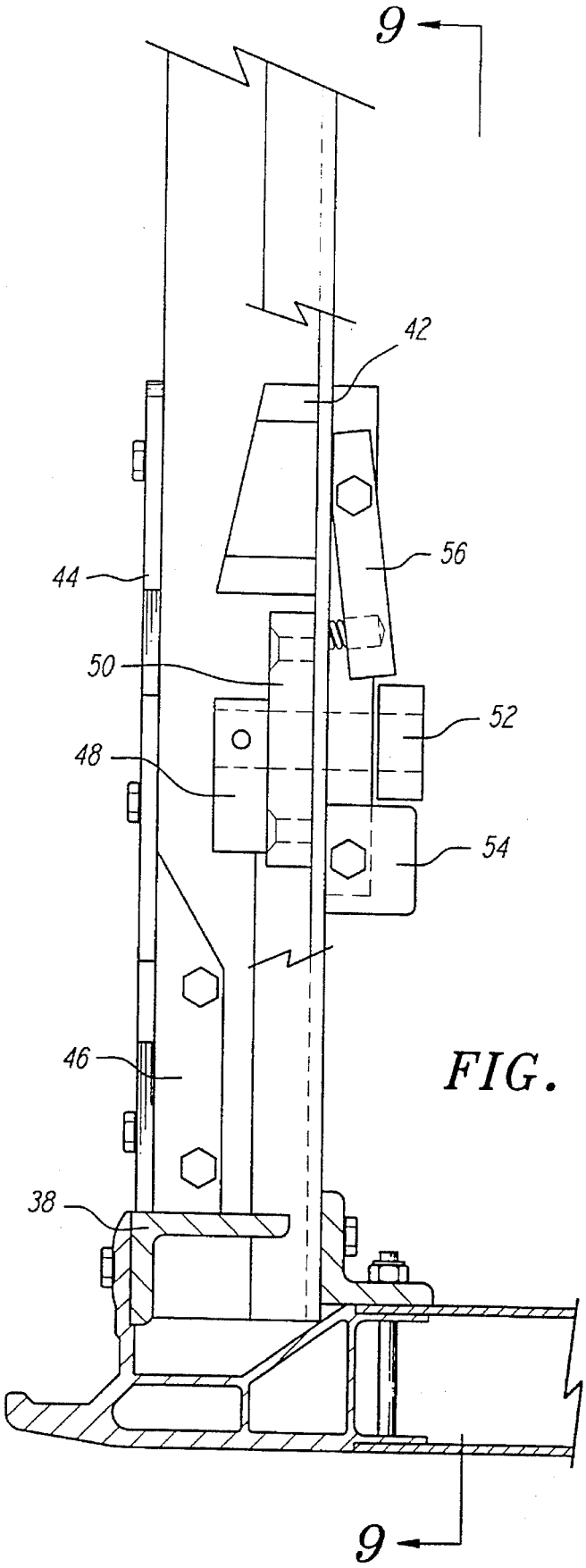
FIG. 8 is a section view thereof, taken along line 8—8 of FIGS. 4 and 7 with the door post cut away and the doorbar omitted for clarity.
Figure 9:
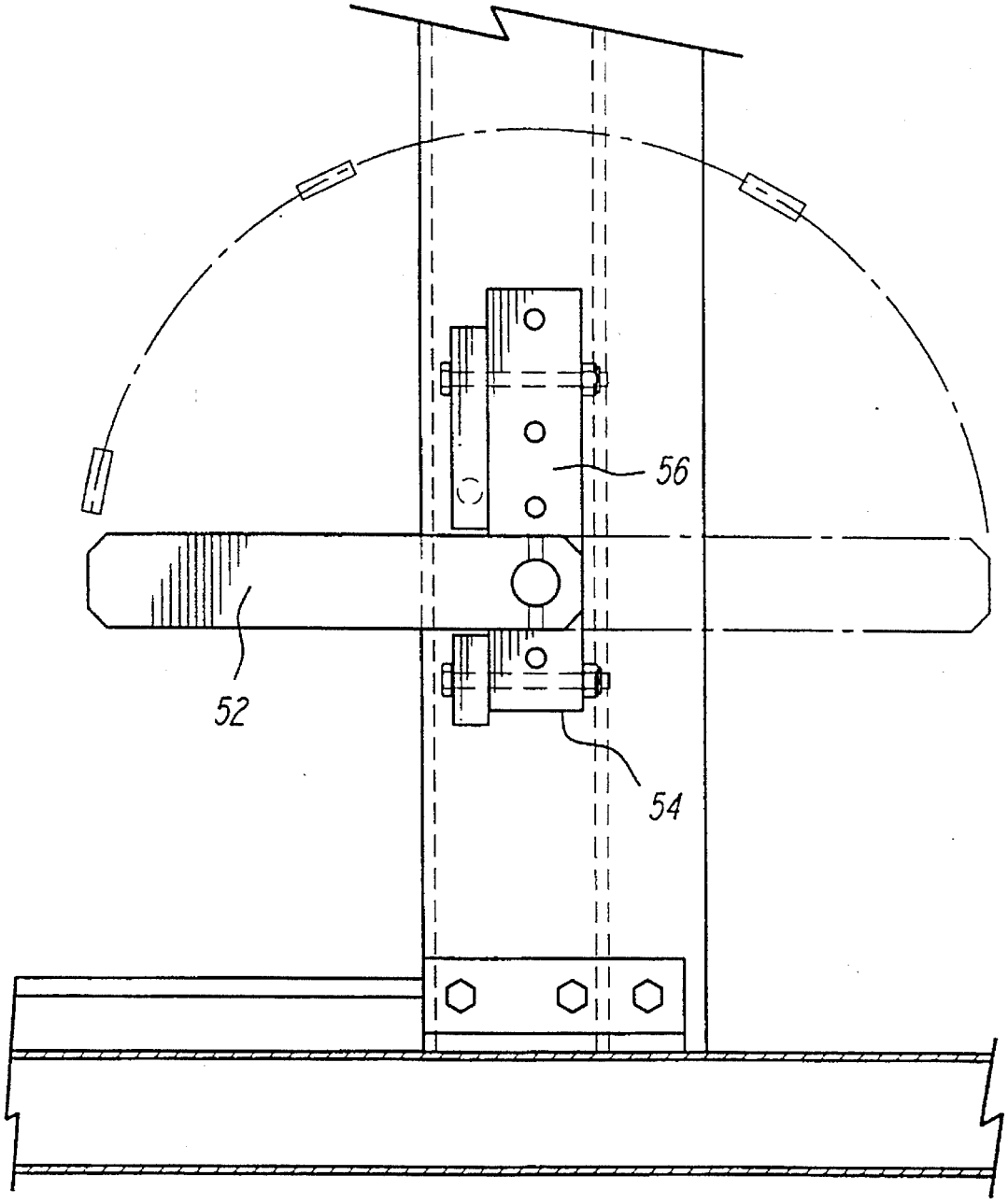
FIG. 9 is a section view thereof taken along line 9—9 of FIG. 8.

Turning to FIG. 7, a latching mechanism for the front roll-up door 22 includes guideplate 44 attached to the frame of the cargo container. A tensioning cam 48 is attached to a cam support block 50 on the frame of the cargo container. An endplate 40 is attached to the doorbar 26, which is attached to the curtain 28. Referring to FIGS. 8 and 9, a ramp 42, a guideplate 44, a handle stop block 54, a spring-loaded handle lock 56, and a threshold angle 38 are attached to the frame. An endplate guide block 46 is attached to the guideplate 44. A handle 52 is rotatably attached to the tensioning cam 48.

Figure 10:
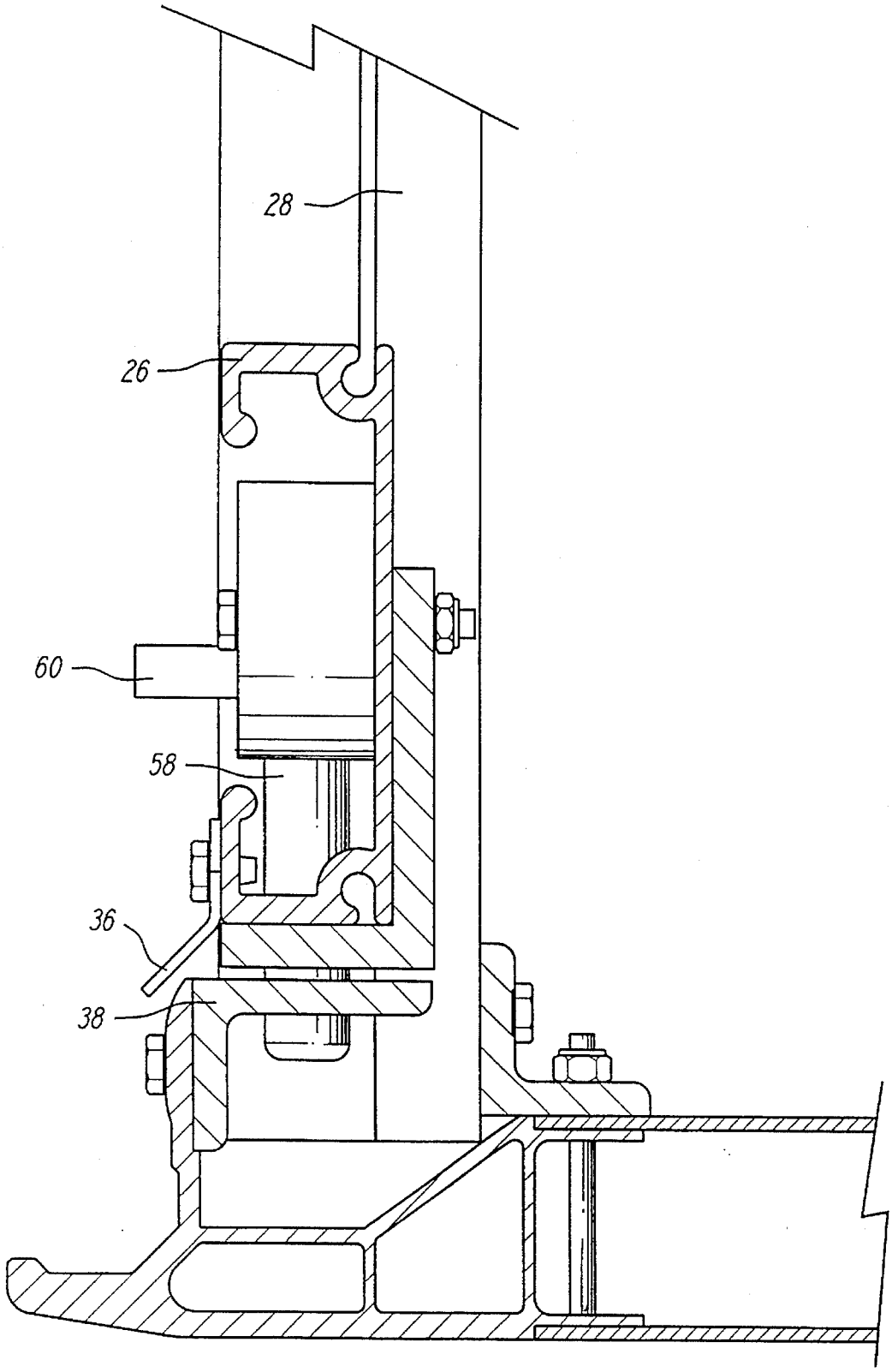
FIG. 10 is a section view of the rear door taken along line 10—10 of FIG. 5.

As shown in FIG. 10, the curtain 28 and rainguard 36 are attached to the doorbar 26. A pin handle 59 is inserted into a moveable lock pin 58 which is attached at the center of the doorbar 26. A threshold angle 38 extends along the front lower section of the frame.

In the preferred embodiment, the latching mechanism for the front roll-up door 22 resides within the interior of the cargo container. To close the door opening, the doorbar 26 with endplates 40 at each end thereof is lowered inside the guideplates 44. The endplates 38 follow the ramps 42 which guide the endplates 40 over the tensioning cam 48. The endplate guide block 46 then causes the endplates 40 to be cammed inwardly, placing them under the door tensioning cam 48 in a pre-locked position. This entire sequence occurs simply by lowering the doorbar 26.

Once the doorbar 26 is thus lowered and placed in the prelocked position, the handles 52 are rotated by hand or foot, 180 degrees, thereby lowering the doorbar 26 further and causing the tensioning cables 32 to be drawn up tight. As the handles 52 are rotated, they pass the spring-loaded handle locks 56 which prevent accidental opening.

Figure 11:
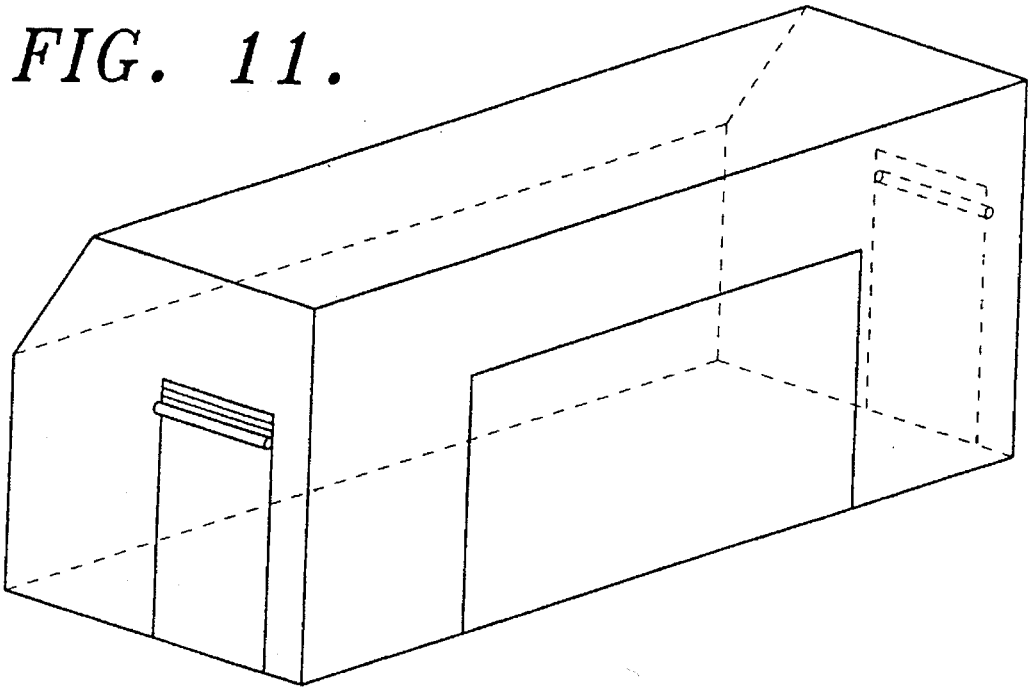
FIG. 11 is a perspective view of the preferred embodiment of the present invention.

To open, the spring-loaded handle locks 56 are depressed, permitting the handles 52 to rotate 180 degrees in the reverse direction. The doorbar 26 is then moved slightly outwardly to clear the tensioning cam 48 and the front roll-up door 22 then rises by virtue of the torsion spring located at the top of the front roll-up door 22. FIG. 11 shows a perspective of the cargo container with the roll-up doors in their opened position.

Cargo is typically loaded in the cargo container through the lateral roll-up door 20. Once loaded, the cargo container is then shipped, typically via aircraft, where it is eventually loaded onto a truck for transportation to final destinations.

Figure 12A:
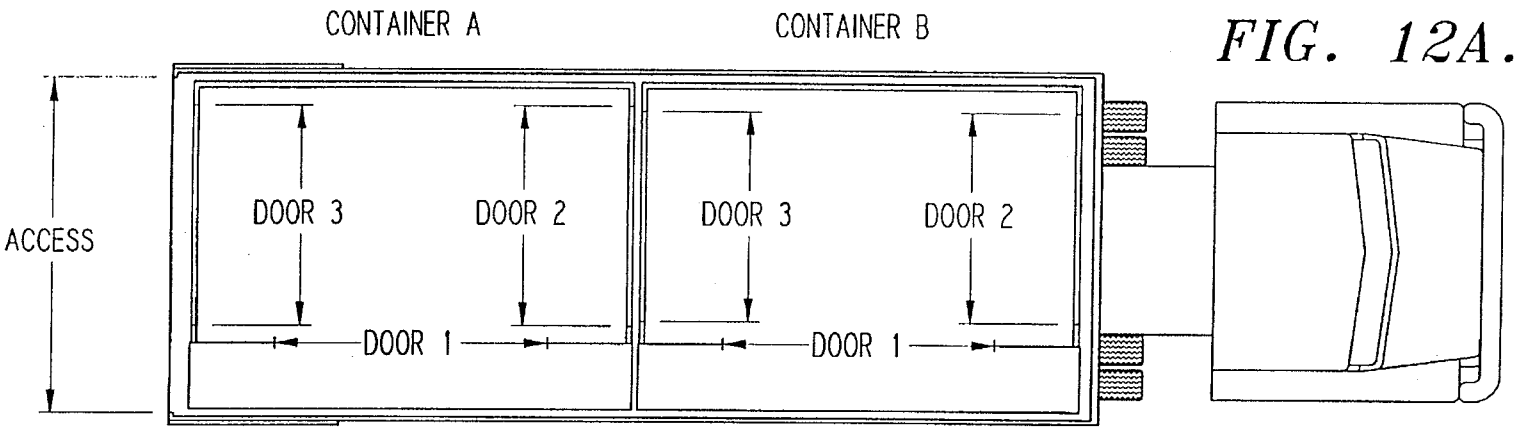
FIG. 12A is a plan view of a preferred method of loading containers onto a truck.

Referring to FIG. 12A, in a preferred method of loading cargo containers into a truck cargo bay, upon reaching its final destination, cargo is unloaded while Containers A and B remain on-board the truck. This scenario may arise through a variety of reasons. For instance, the particular truck station at which cargo is being unloaded may not possess the capability to unload cargo containers from trucks.

Figure 12B:
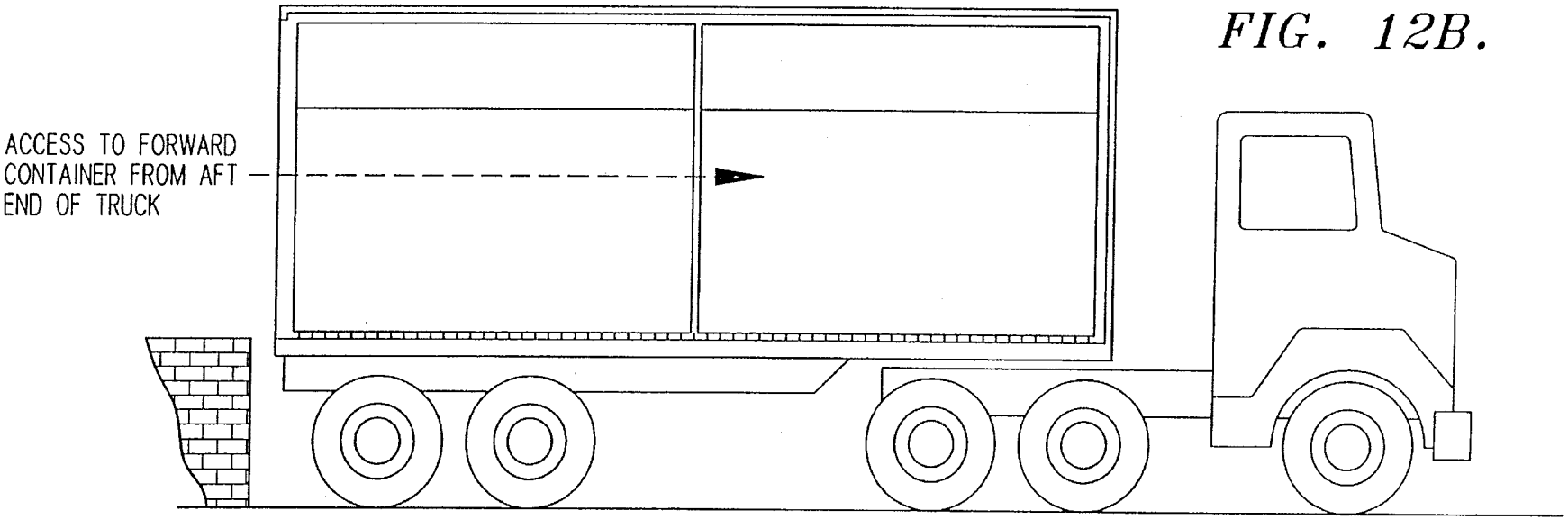
FIG. 12B is a side elevation view thereof.
Figure 13:
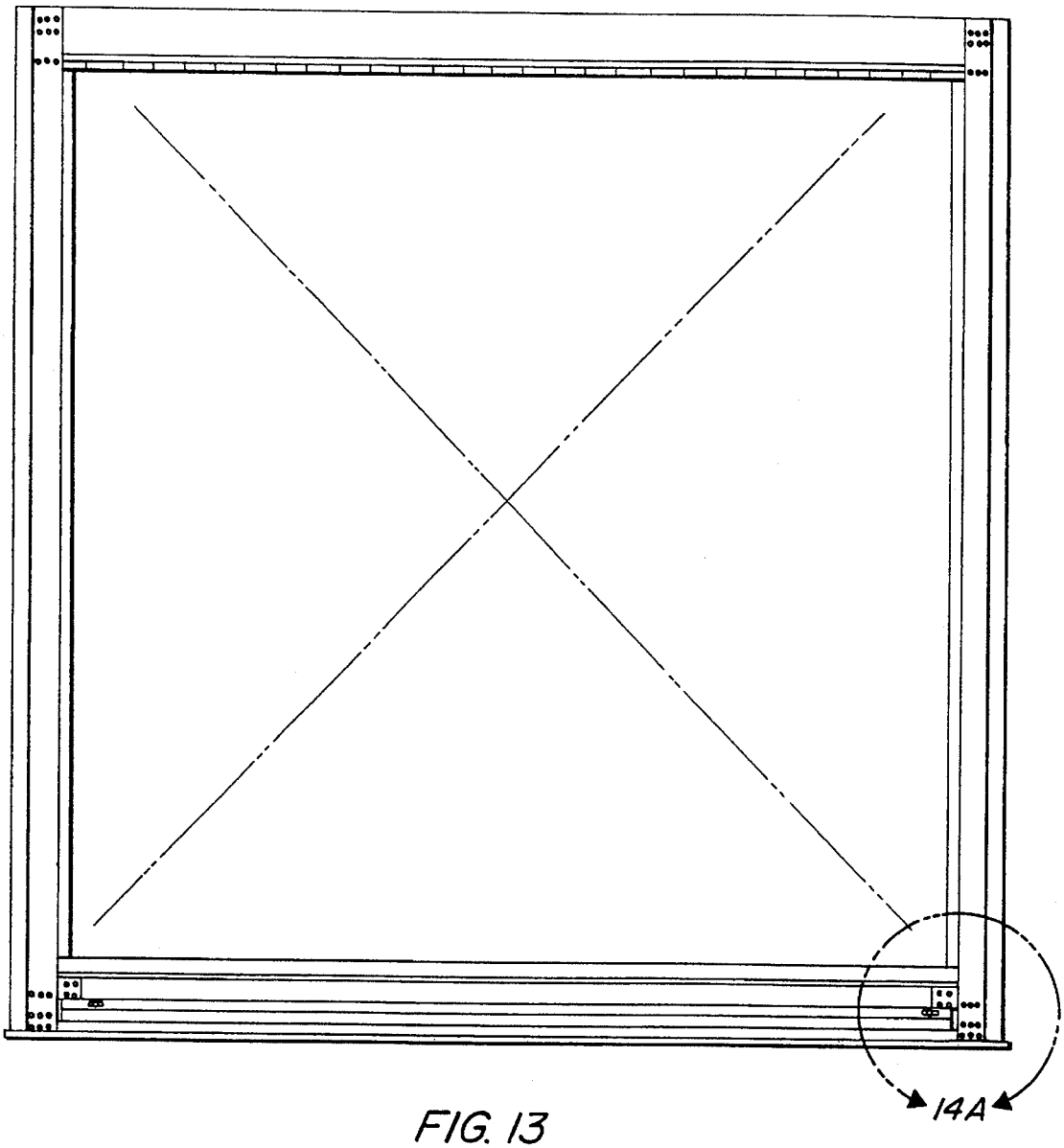
FIG. 13 is a front view of the container in another embodiment of this invention.

For containers situated at the end of the truck, as shown by Container A in FIG. 12A, the rear roll-up door 24 allows access to cargo within Container A. It may also be possible, depending on the truck, to unload cargo through the lateral roll-up door 20. For containers situated further inside the truck cargo bay, as shown by Container B, unloading can likewise be accomplished by first unloading cargo from Container A and then opening door 2 of Container A and door 3 of Container B. As shown in FIG. 12B, a passageway from the rear of the truck, through the interior of Container A, is then created so that cargo from Container B can be unloaded without having to move Container A out of the truck cargo bay. Thus, less free space is needed within Container A to access Container B. In contrast, swinging doors require additional space within Container A for the doors to open into the interior of Container A. The roll-up doors eliminate the need for this extra space. As shown in FIG. 12A, Container A need not be emptied to fully access Container B.

Figure 14C:
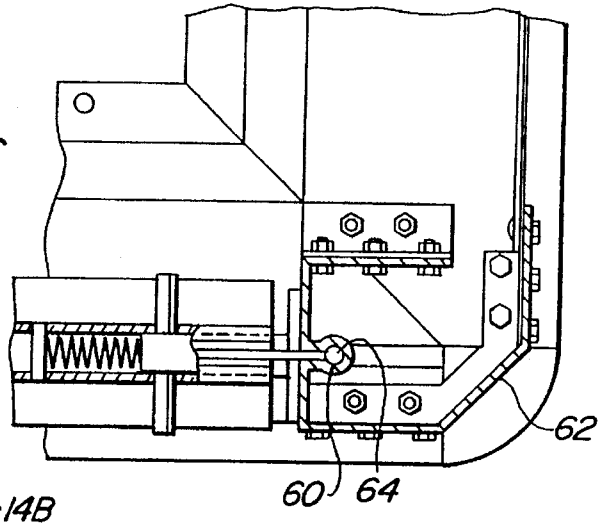
FIG. 14C is a section view taken along line 14C—14C of FIG. 14A.
Figure 14A:
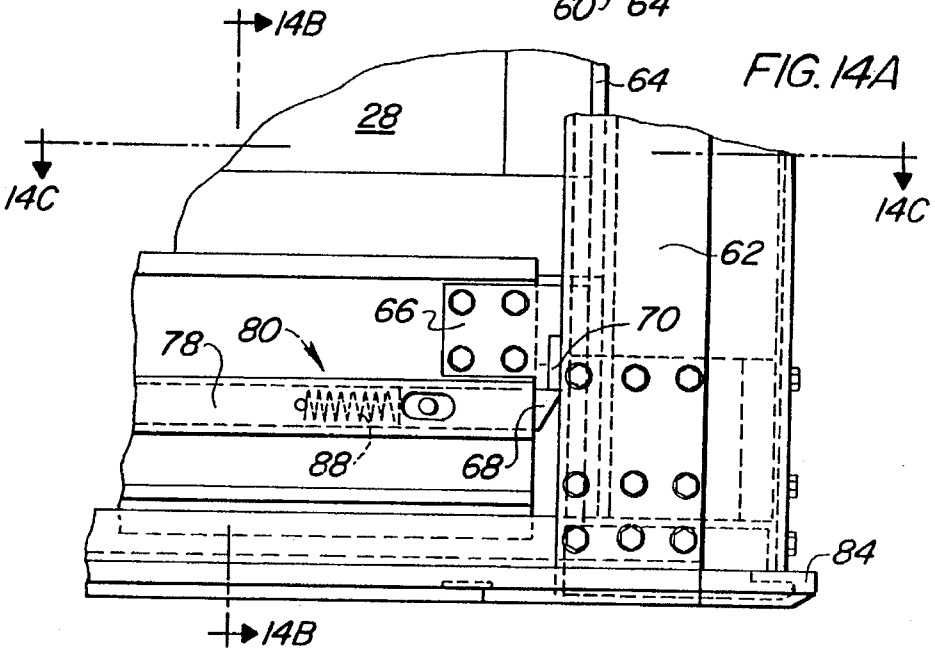
FIG. 14A is an enlarged view of the front lower corner of the container shown in FIG. 13.

Referring to FIGS. 13, 14A, 14B and 14C, in an alternate embodiment, door posts 62 on either side of a curtain 28 each have a recess 60. The curtain may be of any configuration and material, so long as it can roll up and retain cargo. A side elongate retainer 64 is sewn in at the left and right side edges of the curtain 28, with each side retainer 64 slidably positioned within its associated recess 60 in the door post 62. The retainer 64 may be a cable, a flexible rod, or most preferably, a spring. The retainer must be strong enough in compression to withstand the forces tending to compress it when cargo moves against the curtain, and yet flexible enough to be rolled up with the door. The compression forces on the retainer arise as the in-plane tension on the curtain caused by the membrane loading tends to pull the retaining element against the recess 60. A spring retaining element is preferred as it is strong enough in compression to keep the door edges in place under stress conditions, yet it allows the door to easily roll up and down, lightweight and inexpensive. The spring advantageously has high strength in radial compression, yet has low stiffness in bending. The cross section shape of the retainer preferably matches the shape of the recess to reduce stresses. While FIG. 14C shows round shapes, other recess and retainer shapes, e.g., square, rectangular, etc. may also be used.

A doorbar 68 is attached at the bottom edge of the curtain 28. The doorbar 68 has a web 78 and a protrusion 74. An end plate 66 is attached on either side of the doorbar 68, and extends into the recess 60, on both sides of the container. The threshold 84 has a slot 76 which receives the protrusion 74 on the doorbar 68.

A latch 80 on the doorbar 68 has a pin 86 biased outwardly by a spring 88. An arm 90 extends through the pin 86. A latch plate 70 is attached to the lower end of each door post 62. Preferably, the door posts 62, doorbar 68 and threshold 84 are extrusions.

In use, the sewn in springs 64 slide up and down within the recesses 60, as the door is raised and lowered, and hold the curtain 28 in place along the height of the door posts 62. When the curtain 28 is closed, the container is better sealed against water entry, via the engagement of the sides of the curtain 28 and springs 64 positioned in the recesses 60. As the side edges of the curtain 28 cannot come free or move away from the door posts 62, any cargo within the container which moves or shifts against the curtain is still held securely within the container. While the curtain 28 may be somewhat displaced by shifting cargo, it cannot come free of the door posts 62. When closed, the curtain 28 is held in position at the top by the top roller, at the bottom by the doorbar 68, and at the sides by the door posts 62. The curtain 28 accordingly resists deflection, like a drum surface.

To close and lock the door, the doorbar 68 is lowered, with the end plates 66 sliding in the recesses 60. As the doorbar 68 moves downwardly, the pin 86, which has an angled front surface, slides over the latch plate 70 and is pushed back into the doorbar 68, against the force of the compression spring 88. After the pin 86 passes over the latch plate 70, it snaps back outwardly, and is held in position underneath the latch plate 70. The protrusion 74 on the doorbar 68 slides into the slot 76 in the threshold, with the web 78 coming to rest against the top of the threshold.

Figure 14B:
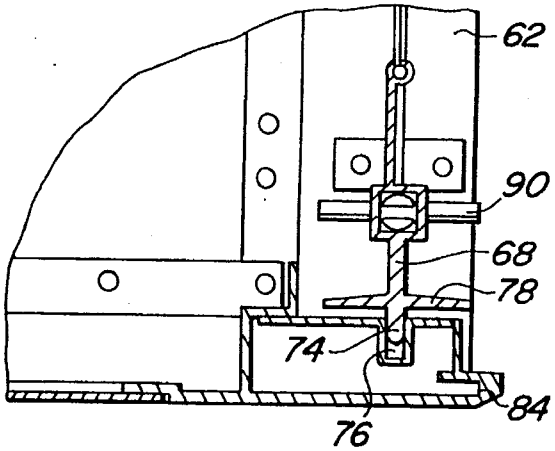
FIG. 14B is a section view taken along line 14B—14B of FIG. 14A.

To open the door, the arm 90 is pulled back to allow the pin 86 to clear the latch plate 70. As shown in FIG. 14B, the arm 90 can be accessed from the inside or outside of the container. Lowering the doorbar 68 over the latch plate 70 causes the latch 80 to automatically engage and lock the door in the closed position.

While preferred embodiments and applications have been shown and described, it will be apparent to those skilled in the art that many modifications are possible without departing from the spirit and scope of the invention.

What is claimed is:

1. A door assembly for a cargo container, comprising:

a first door post spaced apart from a second door post, each door post having an upper end and a lower end;

a transom connecting the upper ends of the door posts;

a threshold connecting the lower ends of the door posts;

a flexible curtain having a first side edge and a second side edge;

a doorbar attached to a lower edge of the curtain and having a first plate slidably positioned in a first recess in the first door post, and a second plate slidably positioned in a second recess in the second door post, with the first and second recesses extending in the first and second door posts, respectively, substantially from the threshold to the transom;

a first retainer spring attached to the first side edge of the curtain and extending substantially the length thereof and slidably positioned within substantially the entire length of the first recess, and a second retainer spring attached to the second side edge of the curtain and extending substantially the length thereof and slidably positioned within the entire length of the second recess; and a latch for latching the doorbar into a closed position.

2. The cargo container of claim 1 further comprising a curtain roller attached to the curtain at an upper edge of the curtain between the first and second door posts.

3. The air cargo container of claim 2 further comprising a threshold extending between the first and second door posts, and spaced apart from the roller.

4. The air cargo container of claim 3 further comprising a protrusion on the doorbar engageable into a slot in the threshold.

5. The air cargo container of claim 1 further comprising a latch on the doorbar and a latch plate on the first door post.

6. The air cargo container of claim 5 further comprising an arm associated with the latch, with the arm accessible from inside or outside the container.

7. The air cargo container of claim 1 wherein the curtain is flexible material selected from the group consisting of a net, a web, and a continuous sheet of material without openings.

* * * * *